US008020730B2

(12) United States Patent
Liang et al.

(10) Patent No.: US 8,020,730 B2
(45) Date of Patent: Sep. 20, 2011

(54) SLOSH CONTROLLED PERSONAL HYDRATION SYSTEM

(75) Inventors: Ezra Liang, San Francisco, CA (US); Page Hadden, San Rafael, CA (US); Tae Kim, San Francisco, CA (US); Winston Shih, New York, NY (US)

(73) Assignee: The North Face Apparel Corp., Wilmington, DE (US)

( * ) Notice: Subject to any disclaimer, the term of this patent is extended or adjusted under 35 U.S.C. 154(b) by 155 days.

(21) Appl. No.: 12/034,726

(22) Filed: Feb. 21, 2008

(65) Prior Publication Data

US 2009/0212081 A1 Aug. 27, 2009

(51) Int. Cl.
*B67D 7/84* (2010.01)

(52) U.S. Cl. ..... 222/175; 224/148.4

(58) Field of Classification Search ..... 222/175; 224/148.1–148.7, 153; 220/717–723, 528–535
See application file for complete search history.

(56) References Cited

U.S. PATENT DOCUMENTS

| | | | | |
|---|---|---|---|---|
| 4,248,366 | A * | 2/1981 | Christiansen | 224/148.6 |
| 4,272,768 | A * | 6/1981 | Rookard, Jr. | 342/7 |
| 4,550,848 | A * | 11/1985 | Sucato | 220/501 |
| 4,768,674 | A * | 9/1988 | Prescott | 220/719 |
| 5,085,349 | A | 2/1992 | Fawcett | |
| 5,934,599 | A * | 8/1999 | Hammerslag | 242/396.1 |
| 6,220,490 | B1 | 4/2001 | O'Hara | |
| 6,267,390 | B1 * | 7/2001 | Maravetz et al. | 280/14.21 |
| 6,409,048 | B1 * | 6/2002 | Belzeski | 222/103 |
| 6,722,533 | B2 * | 4/2004 | Skillern | 222/175 |
| 6,848,472 | B2 * | 2/2005 | Bambacigno | 137/574 |
| 7,490,740 | B2 * | 2/2009 | Robins et al. | 222/175 |
| 7,600,656 | B2 * | 10/2009 | Karl et al. | 222/175 |
| 2002/0113101 | A1 * | 8/2002 | Skillern | 224/148.2 |
| 2004/0238571 | A1 * | 12/2004 | Noell et al. | 222/175 |
| 2005/0029313 | A1 * | 2/2005 | Robins et al. | 222/490 |
| 2005/0072804 | A1 * | 4/2005 | Brown | 222/175 |

FOREIGN PATENT DOCUMENTS

JP 08-214941 A 8/1996

* cited by examiner

*Primary Examiner* — Lien T Ngo

(74) *Attorney, Agent, or Firm* — Kenyon & Kenyon LLP

(57) ABSTRACT

The present invention relates to a personal hydration system. In one exemplary embodiment, the personal hydration system may comprise a hydration reservoir for containing a supply of hydrating fluid, the hydration reservoir may comprise a plurality of compartments. The hydration reservoir may have a low profile and may comprise at least one baffle.

10 Claims, 13 Drawing Sheets

300

800

SLOSH CONTROLLED PERSONAL HYDRATION SYSTEM

TECHNICAL FIELD

The present invention generally relates to personal hydration systems. More specifically, the present invention relates to apparatus and methods that control the slosh of hydration liquid in a personal hydration system as a user of the personal hydration system participates in various physical activities.

BACKGROUND

People doing exercises, such as, bicyclists, hikers, rowers, racers, walkers, and other athletes, frequently utilize what are known as "personal hydration systems" to maintain adequate hydration while engaging in their respective activities. Other individuals may also benefit from such a hydration system, such as construction workers, etc. These personal hydration systems typically have a bag-like fluid reservoir (e.g., a bladder) that is carried in a back or waist-mounted pack. A long, flexible hose is connected to the reservoir at one end and terminates at a mouthpiece at the other end. The hose is long enough to allow the mouthpiece to be carried in the user's mouth to enable the user to draw or suck water from the reservoir at will.

A personal hydration system may be subject to substantial jostling due to body movement of a user while the user is engaging in an activity (e.g., running, biking, hiking, etc.). As a result of this jostling, hydration liquid contained within a fluid reservoir of the personal hydration system is subject to forces to move about actively (e.g., slosh). Slosh of hydration liquid may exert forces on the fluid reservoir and may cause the fluid reservoir to move about actively on the user's body. Further, slosh of hydration liquid in the fluid reservoir may create unpleasant noises when the user is exercising.

The use of baffles to create smaller areas of volume within a larger space in order to reduce liquid movement has been used in oil tankers and other large cargo ships. The lower volume and square area available for liquid movement decreases the disturbance impact from the moving liquid.

BRIEF DESCRIPTION

The present invention is directed to methods and apparatus for controlling slosh (e.g., reducing slosh) in a personal hydration system. The reduction of slosh may be accomplished by forming a hydration reservoir (e.g., a bladder) comprising multiple smaller compartments. In one of many embodiments, for example, the multiple smaller compartments may be created by placing one or more baffles in the hydration reservoir. The baffles may be placed in different orientations (e.g., horizontal, vertical). Further, the baffles may be made of porous material to enhance its ability for dampening the movement of hydration liquid. Moreover, baffle material may be flexible and pliable, which may enable easier removal and replacement of the baffles. Once removed, the baffles may be easily cleaned and the internal of bladder may also be easily cleaned. In addition, baffle material may be light and non-absorbing to maximize amount of liquid available to a user. In one particular embodiment, baffle material may have a low freezing point, thus a baffle may be pre-refrigerated before placing into a bladder. This way, the baffle may help to keep hydration liquid cool. In another exemplary embodiment, one or more baffles may be angled to promote liquid to flow to the bottom of the bladder and pool there, thus a user can draw liquid from bladder more easily.

In some exemplary embodiments, one or more baffles may be incorporated into the design and shape of the bladder. For example, baffles may be made integral to the bladder. In another example, the bladder may be made with more than one branch and each branch may form a small compartment.

Other methods and apparatuses may be utilized to reduce slosh as well. For example, a bladder may have a low profile. In one exemplary embodiment, the bladder may have an oval shaped profile that keeps the center of weight low.

The invention may be embodied in numerous other systems and through numerous other methods. The following detailed description, which, when taken in conjunction with the annexed drawings, discloses examples of the invention. Other embodiments, which incorporate some or all of the features, are also possible.

BRIEF DESCRIPTION OF THE DRAWINGS

Referring to the drawings, which form a part of this disclosure.

DETAILED DESCRIPTION

Figure 1:
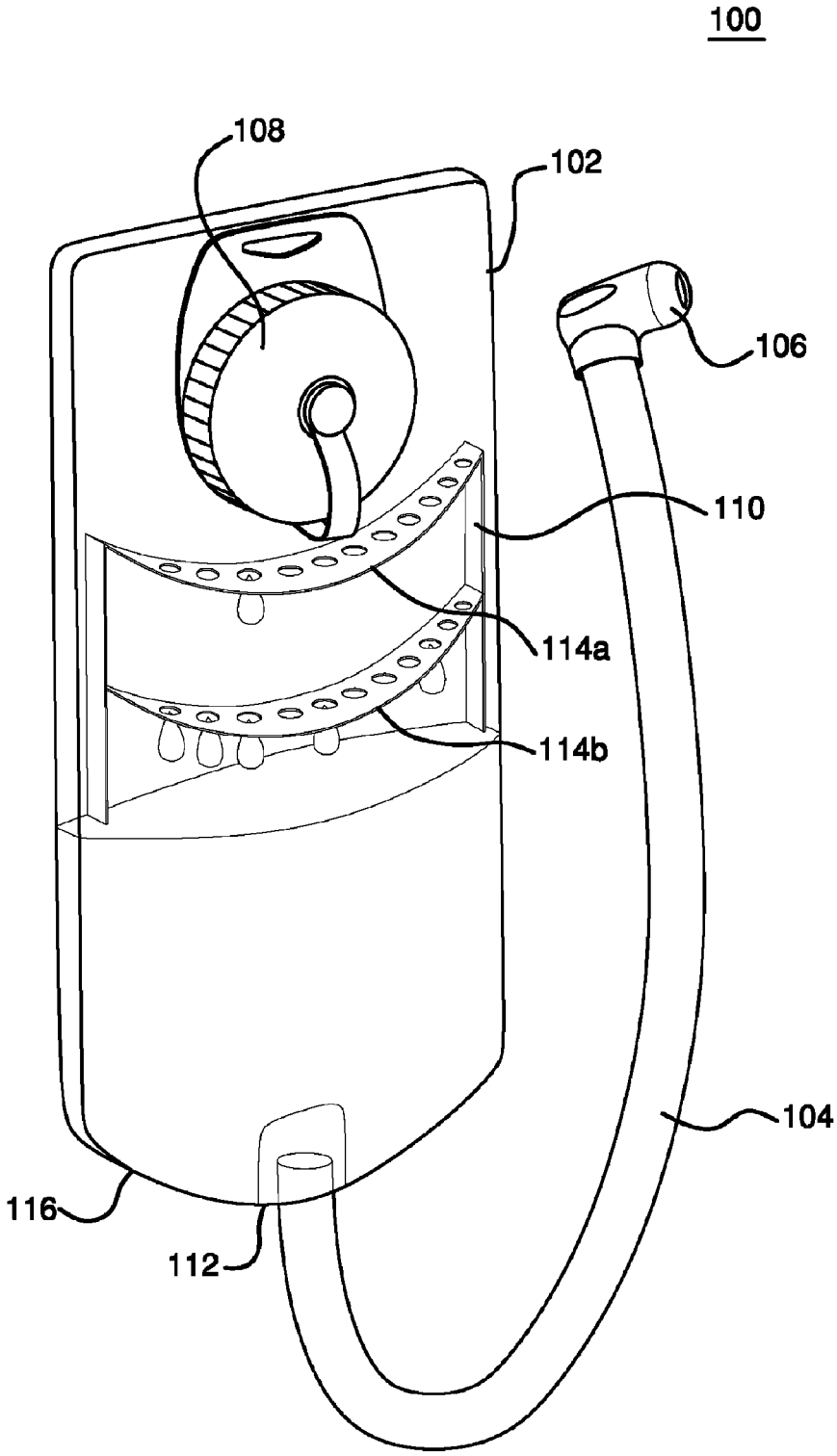
FIG. 1 shows a baffled bladder for a personal hydration system that may be employed in accordance with certain embodiments of the present invention.

FIG. 1 shows a personal hydration system 100 that may be employed in accord with the present invention. The personal hydration system 100 may comprise a baffled hydration reservoir 102, which may be referred to as the baffled bladder 102. The baffled bladder 102 may have a cap 108 near the top and an opening 112 near an elliptically shaped bottom 116. The opening 112 may be connected to a mouth piece 106 (e.g., a nozzle) through a liquid conduit 104 (e.g., a hose). A user may draw hydrating liquid from the baffled bladder 102 through the mouthpiece 106 during physical exercise. The baffled bladder 102 may contain a baffle frame 110. The baffle frame 110 may comprise a plurality of baffles 114*a* and 114*b*. Although in the example, two baffles are shown, any number of baffles may be used.

The elliptical shaped bottom 116 may provide the baffled bladder with a greater capacity and a low center of gravity, thus making it suitable for holding and/or transporting a large volume of liquid. The baffles 114*a* and 114*b* may provide dampening structures to reduce hydration liquid movement.

In FIG. 1, baffles 114*a* and 114*b* may be fixed to the baffle frame 110. In one exemplary embodiment, the baffle frame 110 may not be needed, and the baffles 114*a* and 114*b* may be placed in different orientations (e.g., one horizontal and one vertical, both horizontal, both vertical). Further, the baffles 114*a* and 114*b* may be placed with angles to facilitate hydration liquid to flow to the bottom of the baffled bladder 102. Moreover, there may be less baffles (e.g., just one baffle), or more baffles (e.g., three baffles, four baffles), used in the baffled bladder 102. In one exemplary embodiment, baffles 114*a* and 114*b* may be made of porous material. Porosity may be a factor under consideration for slosh reduction. For example, baffle porosity may be low to impede liquid movement. Likewise, in another example, baffle porosity may be high to facilitate hydration liquid movement (e.g., to converge at the bottom of a bladder). In one or more exemplary embodiments, the porosity of the baffle material, and the number and orientation of baffles, may be combined to achieve slosh reduction.

In some instances, the baffles 114*a* and 114*b* may be made of flexible and/or pliable material, thus they may be easily removed from the baffled bladder 102 for cleaning of the baffled bladder 102 and/or baffles 114*a* and 114*b*. In one exemplary embodiment, the baffle material may be also light and non-absorbing thus making more hydration liquid available to a user. In another exemplary embodiment, the baffle material may also have a low freezing point. Accordingly, the baffle may be pre-refrigerated in a freezer before being put in a bladder, thus keeping hydration liquid in the bladder cool. In at least one exemplary embodiment, the baffle may be made of metal, foam, or inflatable material. In one or more exemplary embodiments, the baffled bladder 102 may be made of plastic or other flexible material.

Figure 2A:
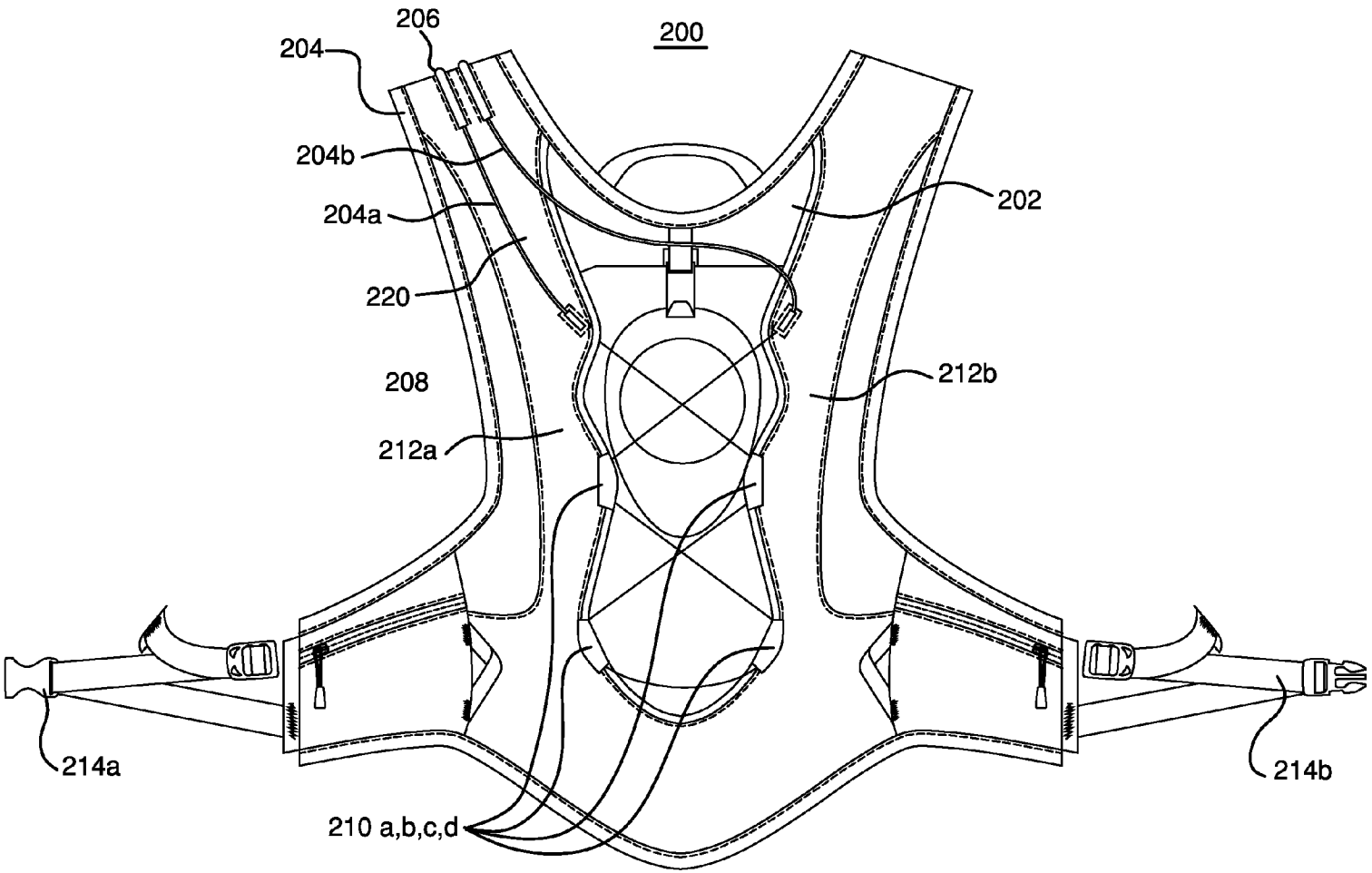
FIG. 2A shows a rear-view of a backpack with a personal hydration system in accordance with certain embodiments of the present invention.
Figure 2B:
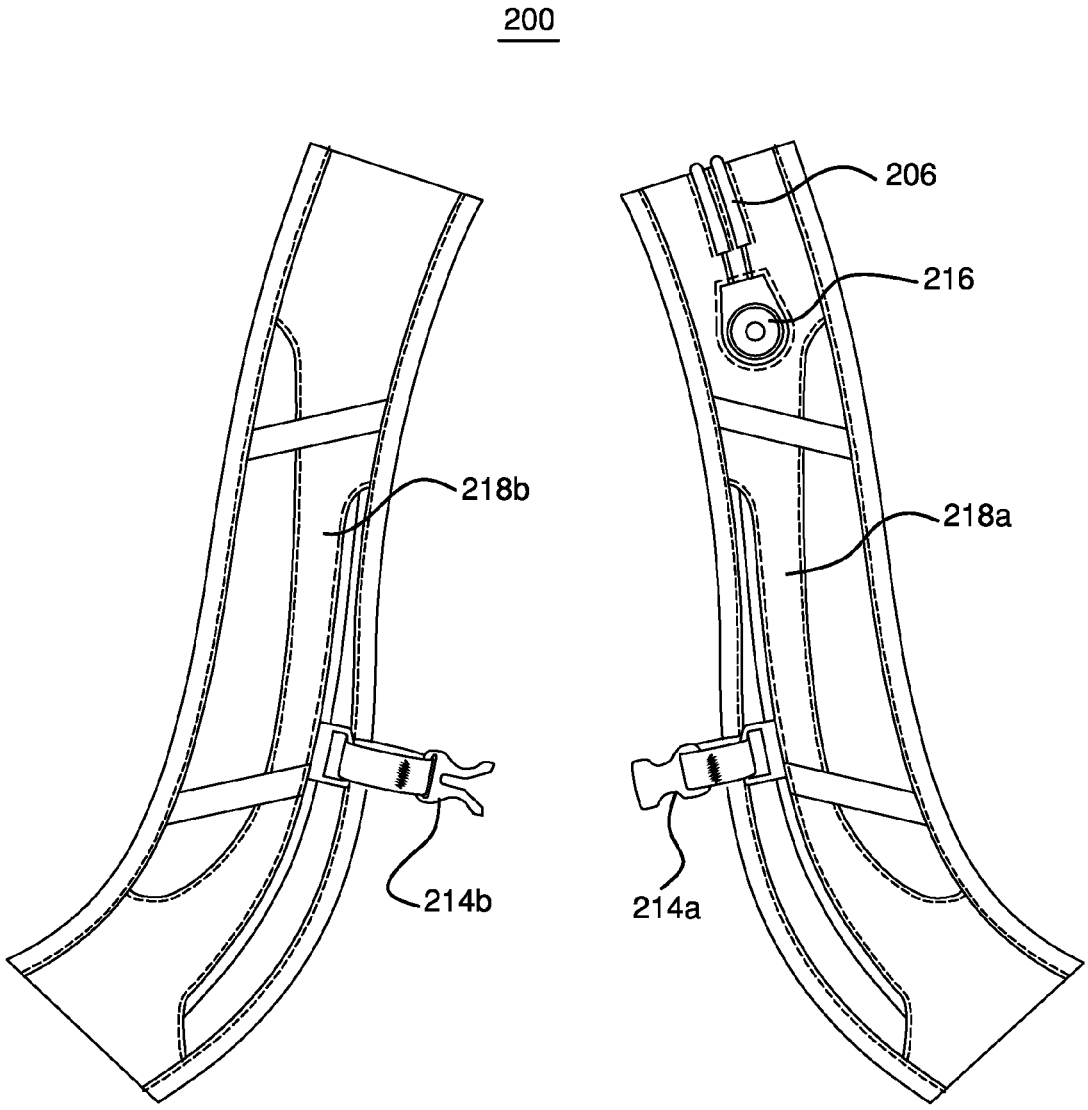
FIG. 2B shows a front-view of the backpack of FIG. 2A in accordance with certain embodiments of the present invention.

FIG. 2A and FIG. 2B show a rear-view and a front-view of a backpack 200 with a personal hydration system in accordance with certain embodiments of the present invention. As shown in FIG. 2A, the backpack 200 may comprise a hydration reservoir compartment 202. The hydration reservoir compartment 202 may contain a hydration reservoir (e.g., a baffled bladder as described previously in FIG. 1). The backpack 200 may also comprise a pressure system which may comprise a cable 220, two cable sheaths 204*a* and 204*b*, a cable housing 206, a lacing system 208 and a plurality of lacing guides 210*a*, 210*b*, 210*c* and 210*d*. The backpack 200 may further comprise a pair of compression wing panels 212*a* and 212*b*. The backpack 200 may be secured on a user's body by detachable straps 214*a* and 214*b*, which are also shown in FIG. 2B. In FIG. 2B, the cable housing 206 is shown to terminate proximate to a cable reel 216 and the backpack 200 may also comprise two compression wing panels 218*a* and 218*b* in the front.

The pressure system of the backpack 200 may provide compression to the hydration reservoir compartment 202. The pressure system may use the cable 220 (e.g., a cord). The cable 220 may engage a steel wire lacing such as, but not limited to, the lacing system 208. An exemplary embodiment of a backpack 200 may use a lacing system 208 in conjunction with the backpack panels to act as a hydration compression system. When the lacing system 208 is engaged through the cable sheaths 204*a* and 204*b* and the plurality of lacing guides 210*a*, 210*b*, 210*c* and 210*d*, the compression forces generated may be applied directly upon hydration reservoir compartment 202 of the backpack 200 and through which applied upon the hydration reservoir contained therein. As the hydration reservoir compression system is further engaged (e.g., by tightening the cord), the hydration reservoir compartment 202 may apply continuous pressure upon the hydration reservoir reducing liquid movement (slosh) and creating a better flow rate through the hydration reservoir and associated drinking hose and nozzle (not shown). When the hydration reservoir compression system is disengaged, compression of the hydration reservoir compartment 202 may be relieved, allowing for removal and refilling of the hydration reservoir. In one exemplary embodiment in accordance with the present disclosure, the hydration reservoir may be a baffled bladder as described previously in reference to FIG. 1.

Figure 3B:
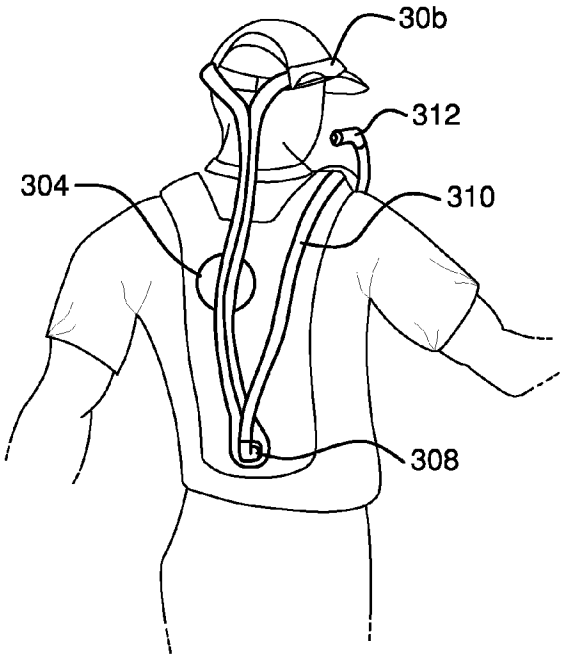
FIG. 3B shows a perspective view of a user wearing the personal hydration system of FIG. 3A in accordance with certain embodiments of the present invention.
Figure 3A:
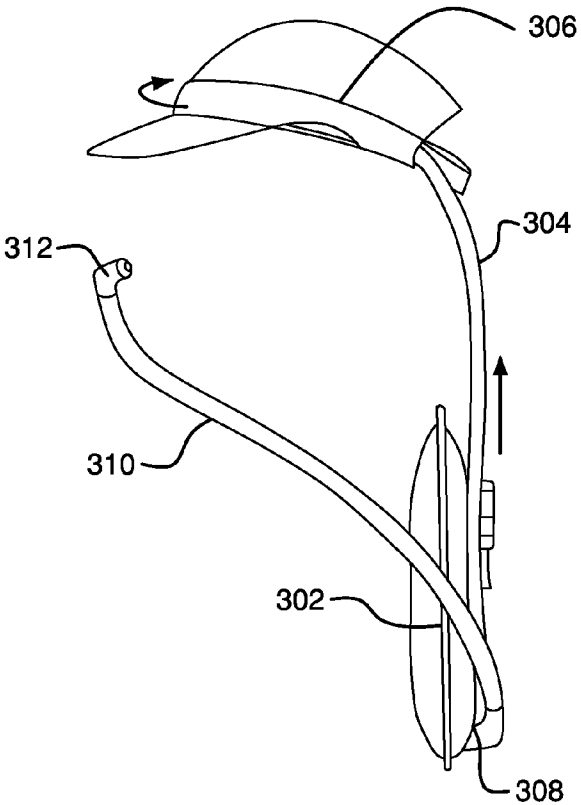
FIG. 3A shows a side-view of a personal hydration system in accordance with certain embodiments of the present invention.

FIGS. 3A and 3B show a side-view and a perspective-view of a personal hydration system 300 in accordance with certain embodiments of the present invention. As shown in FIG. 3A, the personal hydration system 300 may comprise a hydration reservoir 302, a hose 304, a head section 306, a valve 308, a drinking hose 310 and a nozzle 312. The hose 304 at one end may connect to an opening near the bottom of the hydration reservoir 302. The hose 304 then may run through the head section 306 before connecting to the valve 308. The drinking hose 308 may connect the nozzle 312 to the valve 308. In one or more exemplary embodiments, the nozzle 312 may be a mouthpiece that a user may draw hydration liquid. The head section 306 may be a hat that accommodates the hose 304 to run through an inside rim of the hat where the rim touches the head of a user. The hydration reservoir 302 may be a baffled bladder as described previously in reference to FIG. 1.

As shown in FIG. 3B, the personal hydration system 300 is worn by a user. The hose 304 and drinking hose 310 may also be attached to minimize their movement when a user moves. In one or more exemplary embodiments in accordance with certain embodiments of the present invention, the personal hydration system 300 may be put into a hydration reservoir compartment of a backpack (e.g., a backpack as shown in FIGS. 2A and 2B). When a user drinks hydration liquid through the nozzle 312 as shown in FIG. 3B, hydration liquid may run through the hose 304 and the head section 306 before flowing to the drinking hose 310 and the nozzle 312. Hydration liquid may thus act as a cooling agent to cool the user's head.

Figure 4:
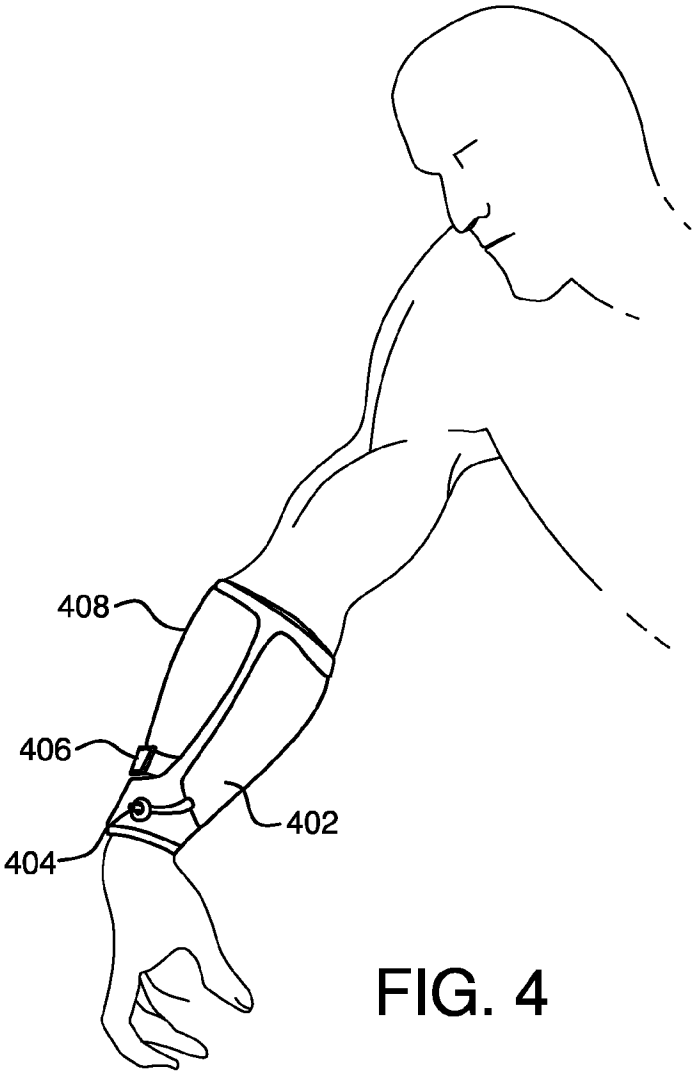
FIG. 4 shows a perspective view of a personal hydration system worn by a user in accordance with certain embodiments of the present invention.

FIG. 4 shows a perspective view of a personal hydration system 400 worn by a user in accordance with other embodiments of the present invention. As shown in FIG. 4, the personal hydration system 400 may comprise a low profile reservoir 402, a mouth piece 404, a watch 406 and a sweat band 408. During a physical exercise, a user may use the mouth piece 404 to draw hydration liquid from the low profile reservoir 402. Further, the user may use watch 406 as a sport watch. The sweat band 408 may also facilitate physical exercise of the user. In one or more exemplary embodiments, the watch 406 and/or sweat band 408 may be optional. Moreover, the personal hydration system 400 may optionally comprise a map and/or a dry erase board. The watch 406, sweat band 408, map and dry erase board may be part of a multi-function panel.

Figure 5B:
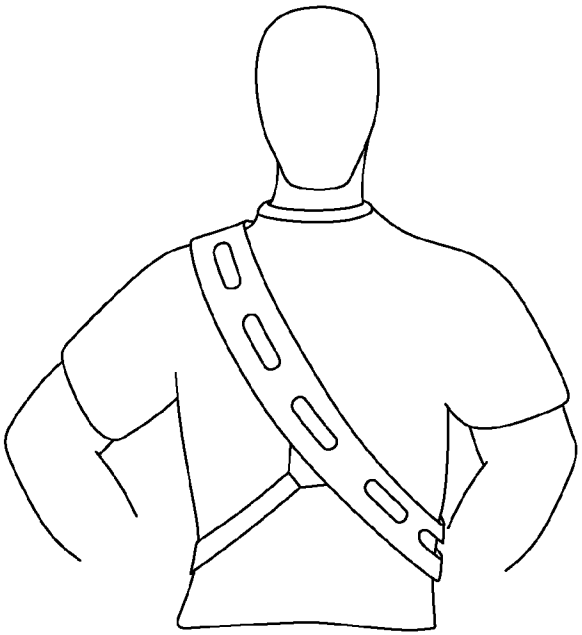
FIG. 5B shows a front-view of a personal hydration system in accordance with certain embodiments of the present invention.
Figure 5A:
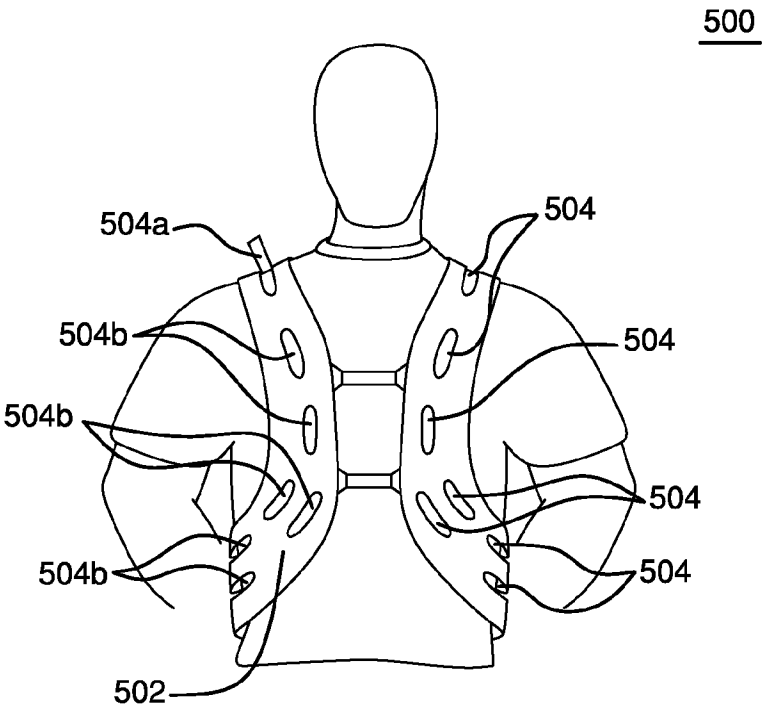
FIG. 5A shows a front-view of a personal hydration system in accordance with certain embodiments of the present invention.

FIGS. 5A and 5B show a front-view and a rear-view of a personal hydration system 500 in accordance with certain embodiments of the present invention. As shown in FIG. 5A, the personal hydration system 500 may comprise a low profile reservoir 502 and a plurality of perforated baffles. The low profile reservoir 502 may wrap around a user's body. The combination of low profile and baffles may reduce the slosh caused by movement of hydration liquid within the low profile reservoir 502. The perforated baffles reduce volume in an already low profile bladder, i.e. minimized volume. Slosh is minimized since liquid has less room to move around in the small volume and square area. Furthermore, the perforated baffles reduces the overall weight of the bladder.

Figure 6B:
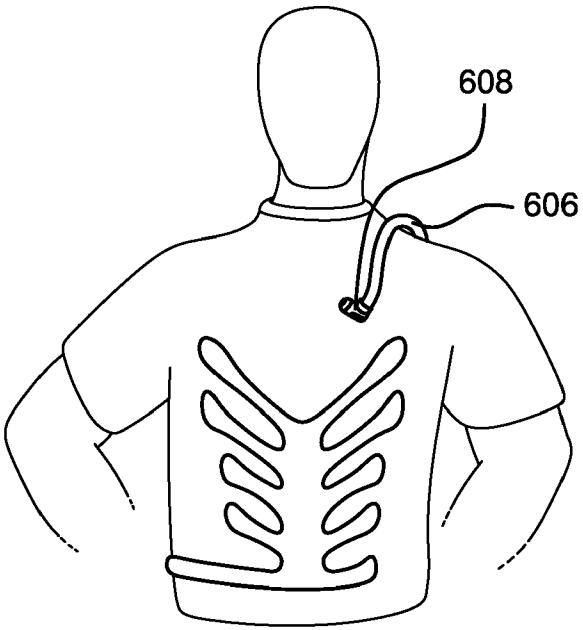
FIG. 6B shows a front-view of the personal hydration system of FIG. 6A in accordance with certain embodiments of the present invention.
Figure 6A:
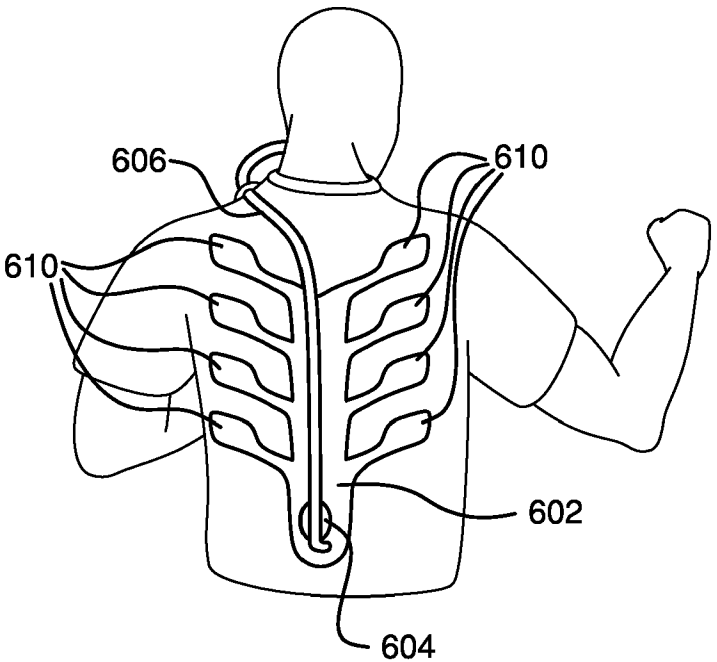
FIG. 6A shows a rear-view of a personal hydration system in accordance with certain embodiments of the present invention.

FIGS. 6A and 6B show a front-view and a rear-view of a personal hydration system 600 in accordance with certain embodiments of the present invention. As shown in FIG. 6A, the personal hydration system 600 may comprise a low profile reservoir 602. The low profile reservoir 602 may comprise a plurality of branches 610. The low profile reservoir 602 and the plurality of branches 610 may wrap around a user's body. The personal hydration system 600 may further comprise an opening 604 near bottom of the low profile reservoir 602. The opening 604 may be connected to a drinking hose 606. The drinking hose 606 may be connected to a mouthpiece 608 as shown in FIG. 6B. The combination of low profile and plurality of branches may reduce the slosh caused by movement of hydration liquid within the low profile reservoir 602. In one or more exemplary embodiments, the low profile reservoir 602 may be removably attached to a shirt in the fashion of a harness. In another exemplary embodiment, the low profile reservoir 602 may be integrated into a shirt (e.g., built into a shirt). Further, the low profile reservoir 602 may wrap around the body to mimic the spine and/or ribs to offer a front and back system. Alternatively, the low profile reservoir 602 may wrap around the body in any pattern and with just a front or a back.

Figure 7C:
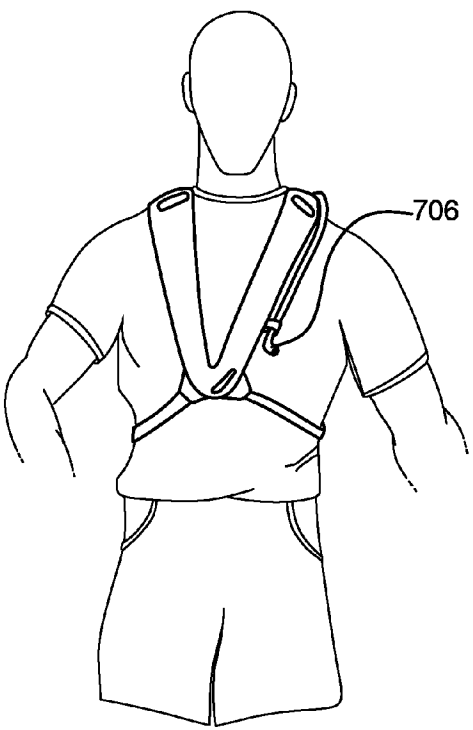
FIG. 7C shows a front-view of another embodiment of the personal hydration system of FIG. 7A in accordance with certain embodiments of the present invention.
Figure 7B:
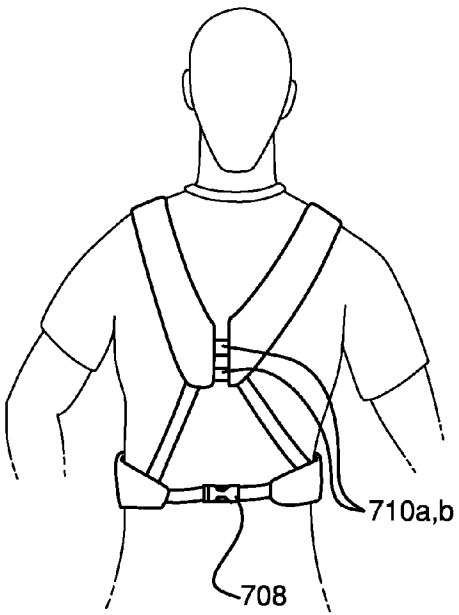
FIG. 7B shows a front-view of the personal hydration system of FIG. 7A in accordance with certain embodiments of the present invention.
Figure 7A:
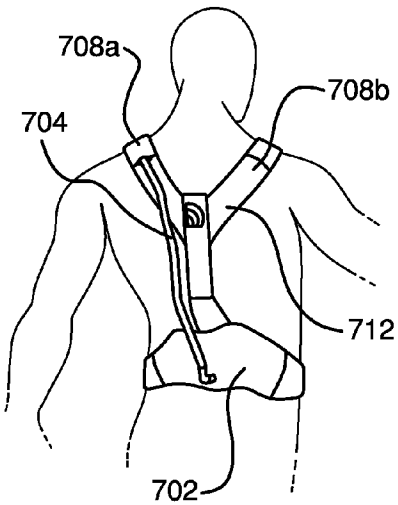
FIG. 7A shows a rear-view of a personal hydration system in accordance with certain embodiments of the present invention.

FIGS. 7A, 7B and 7C show a rear-view, two alternative front-views of a personal hydration system 700 in accordance with certain embodiments of the present invention. As shown in FIG. 7A, the personal hydration system 700 may comprise a low profile contoured lumbar reservoir 702, a drinking hose 704 and two shoulder straps 708*a* and 708*b*. The two shoulder straps 708*a* and 708*b* may be fluidly connected in a v-shaped joint 712. The v-shaped joint 712 may be further fluidly connected to the low profile contoured lumbar reservoir 702. The drinking hose 704 may be removably attached to the shoulder strap 708*a*. Alternatively, the drinking hose 704 may be removably attached to the shoulder strap 708*b*. A nozzle 706 may be connected to the drinking hose 704 as shown in FIG. 7C. The two shoulder straps 708*a* and 708*b* may be fixed together by two straps 710*a* and 710*b* as shown in FIG. 7B. Another strap 708 may be used to fit the personal hydration system 700 to a user's body. Alternatively, as shown in FIG. 7C, the two shoulder straps 708*a* and 708*b* may be joined together (e.g., fluidly connected) in the front of the personal hydration system 700. The low profile v-shaped reservoir may wrap around a user's body for an improved fit for the personal hydration system 700. Further, the lumbar reservoir may increase liquid capacity. In one or more exemplary embodiments, the lumbar reservoir may contain baffles as described previously in reference to FIG. 1. The combination of low profile and baffles may reduce the slosh caused by movement of hydration liquid.

Figure 8B:
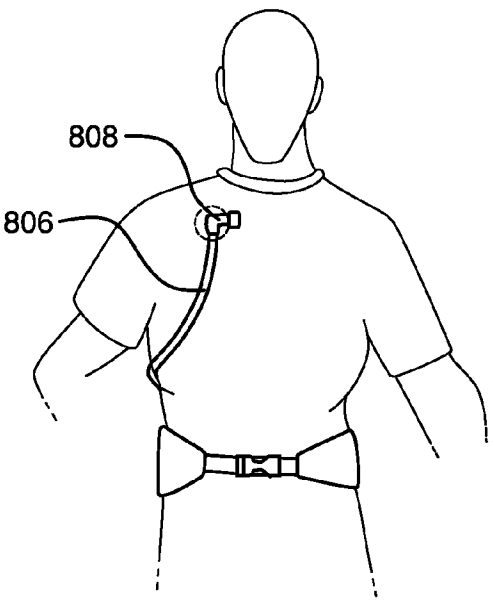
FIG. 8B shows a front-view of the personal hydration system of FIG. 8A in accordance with certain embodiments of the present invention.
Figure 8A:
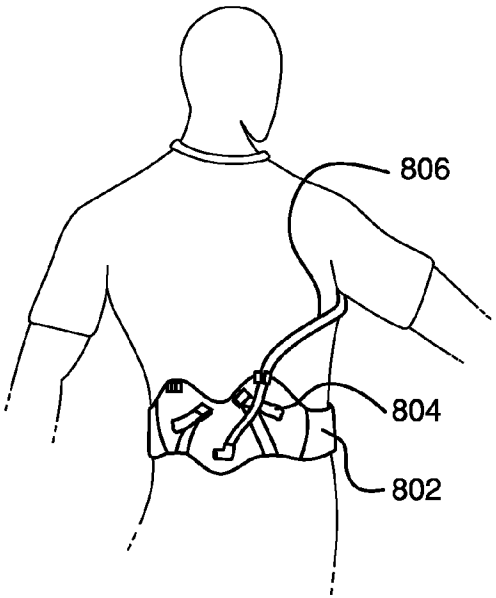
FIG. 8A shows a rear-view of a personal hydration system in accordance with certain embodiments of the present invention.

FIGS. 8A and 8B show a rear-view and a front-view of a personal hydration system 800 in accordance with other embodiments of the present invention. As shown in FIG. 8A, the personal hydration system 800 may comprise a hydration reservoir 802, a hose 806 and a clip 804. The hydration reservoir 802 may be in a contoured lumbar shape. The contoured lumbar shape may help the hydration reservoir reduces slosh and forms to the body of a user. The hose 806 may be connected to a mouthpiece 808 as shown in FIG. 8B. The hose 806 may be secured to the hydration reservoir 802 by the clip 804. A user of the personal hydration system 800 may draw hydration liquid from the hydration reservoir 802 through the mouthpiece 808. The mouthpiece 808 may be attached to a shirt of the user when not in use. In one or more exemplary embodiments, the mouthpiece 808 may be a magnetic bite valve. The magnetic bite valve may be mounted to a valve mount integrated into the user's shirt.

Figure 9B:
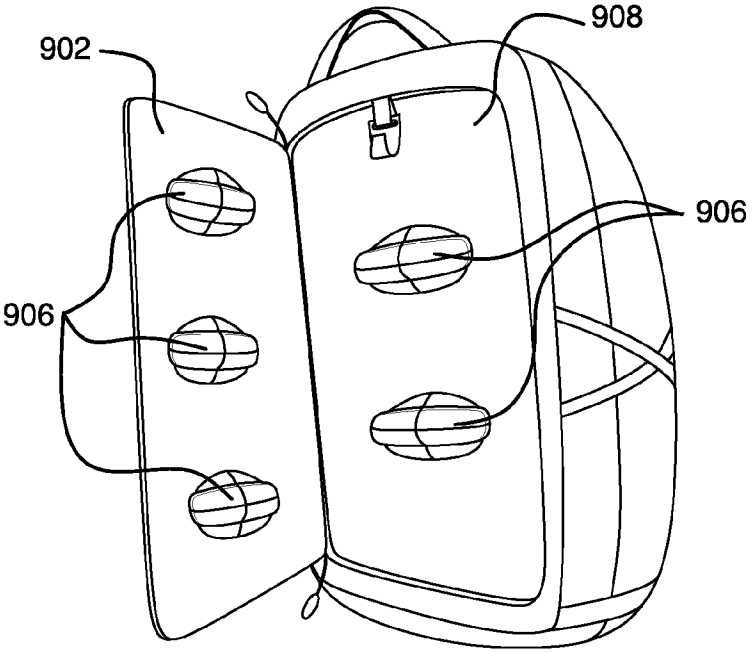
FIG. 9B shows another embodiment of an external baffle system of FIG. 9A in accordance with certain embodiments of the present invention.
Figure 9A:
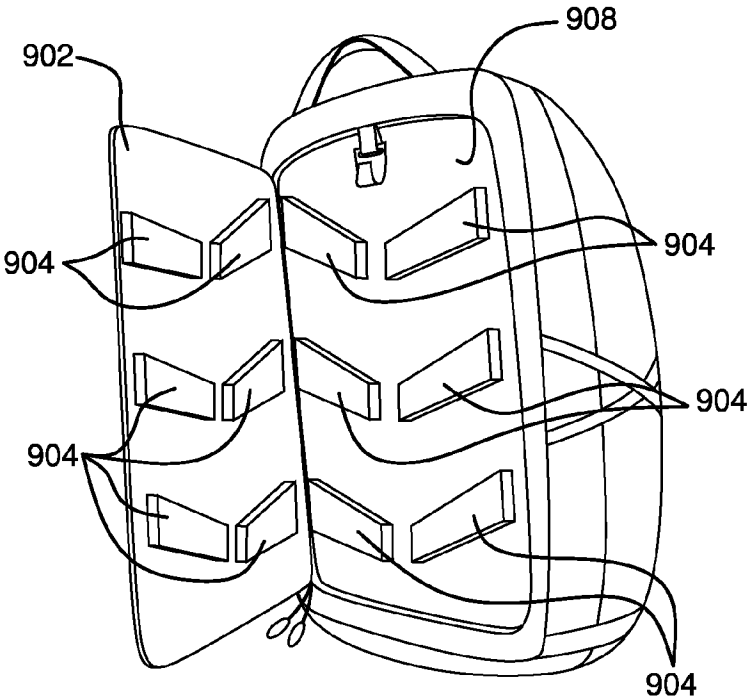
FIG. 9A shows one embodiment of a an external baffle system in accordance with certain embodiments of the present invention.

FIGS. 9A and 9B show two exemplary embodiments of a hydration reservoir compartment with external baffles 900 in accordance with certain embodiments of the present invention. As shown in FIG. 9A, the hydration reservoir compartment 900 may comprise a back panel 902 and a front panel 908. A plurality of baffles 904 may be attached to the back panel 902 and the front panel 908. When the back panel 902 and front panel 908 is sealed together with a bladder in between to form a closed system, the baffles 904 may compress portions of the bladder in hydration reservoir compartment with external baffles 900. The combination of compression (e.g., sandwiches the bladder) and baffles may reduce the slosh caused by movement of hydration liquid. In FIG. 9B, there is shown another embodiment of the hydration reservoir 900. A plurality of baffles 906 may be in different shape and arrangement in comparison to the baffles 904. In one or more exemplary embodiments, other shapes and arrangement of baffles may be used in accordance with the present disclosure.

Figure 10:
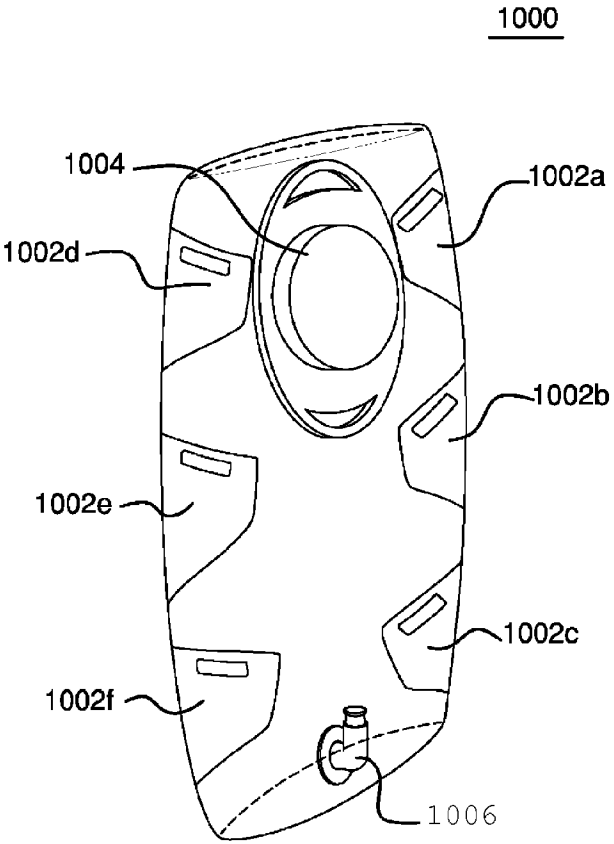
FIG. 10 shows a hydration reservoir in accordance with certain embodiments of the present invention.

FIG. 10 shows a hydration reservoir 1000 in accordance with certain embodiments of the present invention. The hydration reservoir 1000 may comprise a cap 1004 near the top, a hose connector 1006 near the bottom and a plurality of gel pods 1002. The gel pods 1002*a-f* may serve as baffles to dampen movement of hydration liquid. In one or more exemplary embodiments, the plurality of gel pods 1002 may be refrigerated before putting in the hydration reservoir 1002, thus they may help to keep the hydration liquid cool.

Figure 11:
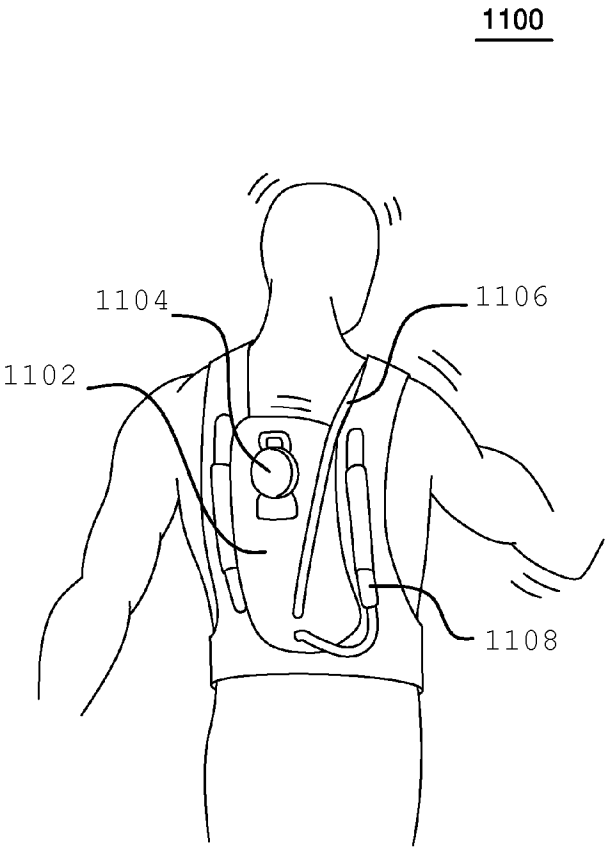
FIG. 11 shows a personal hydration system in accordance with certain embodiments of the present invention.

FIG. 11 shows a personal hydration system 1100 in accordance with certain embodiments of the present invention. As shown in FIG. 11, the personal hydration system 1100 may comprise a hydration reservoir 1102, a cap 1104, a drinking hose 1106 and an air pump 1108. The cap 1104 may be located near the top of the hydration reservoir 1102. The drinking hose 1106 may be connected to the bottom of the hydration reservoir 1102. The air pump 1108 may be fluidly connected to the hydration reservoir 1102. When a user of the personal hydration system 1100 exercises, the user may draw hydration liquid through the drinking hose 1106. At the same time, movement of the user may cause the air pump 1108 to pump air into the hydration reservoir 1102. The air pump is low pressure thus replacing drained liquid with air until volume of bladder is filled without over-inflation. Therefore, as hydration liquid level in the hydration reservoir 1102 may decrease, the overall volume may be kept constant, thus slosh may be reduced.

Figure 12B:
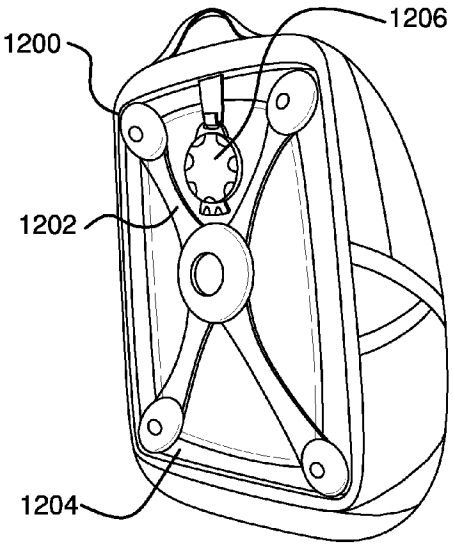
FIG. 12B shows a partly assembled personal hydration and external baffle system of FIG. 12A in accordance with certain embodiments of the present invention.
Figure 12A:
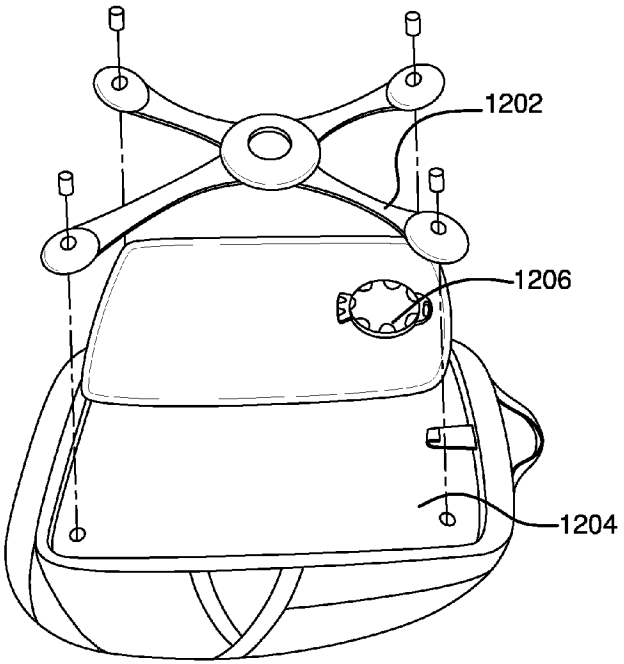
FIG. 12A shows a disassembled personal hydration and external baffle system in accordance with certain embodiments of the present invention.

FIGS. 12A and 12B show a personal hydration system 1200 in accord with the present invention. As shown in FIG. 12A, the personal hydration system 1200 may comprise a frame 1202 and a hydration reservoir 1204. The hydration reservoir 1204 may comprise a removable cap 1206. Hydration liquid may be put in the hydration reservoir 1204 when the removable cap 1206 is removed. The frame 1202 may be an X-shaped frame. As shown in FIG. 12B, when assembled, the pressure created by the snaps pulling on the frame 1202 may compress the hydration reservoir 1204 externally. Further, the frame 1202 may serve as a baffle structure by pressing the hydration reservoir 1204 and protruding into the inner space of the hydration reservoir 1204, thus reducing hydration liquid movement.

The examples described herein are merely illustrative, as numerous other embodiments may be implemented without departing from the spirit and scope of the exemplary embodiments of the present invention. Moreover, while certain features of the invention may be shown on only certain embodiments or configurations, these features may be exchanged, added, and removed from and between the various embodiments or configurations while remaining within the scope of the invention. Likewise, methods described and disclosed may also be performed in various sequences, with some or all of the disclosed steps being performed in a different order than described while still remaining within the spirit and scope of the present invention.

What is claimed is:

1. A backpack including a personal hydration system comprising:

a flexible hydration reservoir for containing a supply of hydrating fluid, the hydration reservoir comprising a plurality of compartments and being disposed within a reservoir compartment, the reservoir compartment being located on an outside surface of the backpack, and a compression system that compresses an external surface of the flexible hydration reservoir, the compression system further comprising:

a cable;

a cable reel to tighten and loosen the cable; and a lacing system engaged with ends of the cable, wherein the compression system operates to apply continuous pressure to the hydration reservoir by tightening of the cable reel so that a wire of the lacing system is compressed, thereby directly applying compression force only to the hydration reservoir, via compression of the reservoir compartment, and wherein the plurality of compartments are formed by at least one baffle placed in the hydration reservoir to reduce hydration fluid movement therein.

2. The backpack of claim 1, wherein the at least one baffle is a gel pad, the gel pad capable of being pre-refrigerated.

3. The backpack of claim 1, wherein the at least one baffle is placed horizontally in the hydration reservoir.

4. The backpack of claim 1, wherein the at least one baffle is placed vertically in the hydration reservoir.

5. The backpack of claim 1, wherein the at least one baffle is placed in an angle in the hydration reservoir, wherein the angle facilitates the hydration liquid to flow to the bottom of the hydration reservoir.

6. The backpack of claim 1, wherein the at least one baffle is perforated.

7. The backpack of claim 1, wherein the at least one baffle is porous.

8. A backpack including a personal hydration system comprising:

a flexible hydration reservoir for containing a supply of hydrating fluid, the hydration reservoir comprising a plurality of compartments and being disposed within a reservoir compartment, the reservoir compartment being located on an outer surface of the backpack, and means for compressing an external surface of the flexible hydration reservoir to apply continuous pressure, thereby directly applying compression force only to the hydration reservoir, via compression of the reservoir compartment.

9. The backpack of claim 8, wherein the plurality of compartments are formed by at least one baffle placed in the hydration reservoir to reduce hydration fluid movement therein, and wherein the at least one baffle is a gel pad, the gel pad capable of being pre-refrigerated.

10. The backpack of claim 1, wherein the wire has a proximal and a distal end engaged with the ends of the cable.

* * * * *